US011828543B2

(12) United States Patent
Noishiki

(10) Patent No.: US 11,828,543 B2
(45) Date of Patent: Nov. 28, 2023

(54) STACKED HEAT EXCHANGER

(71) Applicant: KOBE STEEL, LTD., Hyogo (JP)

(72) Inventor: Koji Noishiki, Takasago (JP)

(73) Assignee: KOBE STEEL, LTD., Hyogo (JP)

( * ) Notice: Subject to any disclaimer, the term of this patent is extended or adjusted under 35 U.S.C. 154(b) by 50 days.

(21) Appl. No.: 17/054,304

(22) PCT Filed: May 21, 2019

(86) PCT No.: PCT/JP2019/020105
§ 371 (c)(1),
(2) Date: Nov. 10, 2020

(87) PCT Pub. No.: WO2019/235211
PCT Pub. Date: Dec. 12, 2019

(65) Prior Publication Data

US 2021/0239403 A1 Aug. 5, 2021

(30) Foreign Application Priority Data

Jun. 6, 2018 (JP) ..... 2018-108693

(51) Int. Cl.
*F28D 9/00* (2006.01)
*F28F 3/04* (2006.01)
(Continued)

(52) U.S. Cl.
CPC ..... *F28D 9/00* (2013.01); *F28F 3/04* (2013.01); *F28F 3/08* (2013.01); *F28F 13/08* (2013.01); *F28F 2265/00* (2013.01)

(58) Field of Classification Search
CPC ..... F28F 2260/02; F28F 13/08; F28F 3/04; F28D 9/00
See application file for complete search history.

(56) References Cited

U.S. PATENT DOCUMENTS 4,765,397 A * 8/1988 Chrysler ..... H01L 23/473 257/E23.098
5,915,469 A * 6/1999 Abramzon ..... F28F 3/025 165/146

(Continued)

FOREIGN PATENT DOCUMENTS

JP 2005-291546 A 10/2005

OTHER PUBLICATIONS

The extended European search report issued by the European Patent Office dated Feb. 11, 2022, which corresponds to European Patent Application No. 19814555.9-1002 and is related to U.S. Appl. No. 17/054,304.

*Primary Examiner* — Paul Alvare
(74) *Attorney, Agent, or Firm* — Studebaker & Brackett PC

(57) ABSTRACT

A stacked heat exchanger has a high temperature layer with a number of channels into which a high temperature-side fluid is introduced; and a low temperature layer superposed on the high temperature layer having a number of channels into which a low temperature-side fluid is introduced at a temperature lower than the temperature of the high temperature-side fluid. Each channel of the low temperature layer has an upstream-side part in which at least some of the low temperature-side fluid evaporates by being heated by the high temperature-side fluid flowing within the high temperature layer; and a downstream-side part in which the low temperature-side fluid that has evaporated in the upstream-side part is heated by the high temperature-side fluid flowing within the high temperature layer. The upstream-side parts of the low temperature layer occupy a total area smaller than a total area of the downstream-side parts of the low temperature layer.

6 Claims, 7 Drawing Sheets

(51) Int. Cl.
*F28F 3/08* (2006.01)
*F28F 13/08* (2006.01)

(56) References Cited

U.S. PATENT DOCUMENTS 10,811,147 B2 10/2020 Kim et al.
2005/0271909 A1* 12/2005 Bai ..... H01M 8/0258 429/492
2005/0274501 A1* 12/2005 Agee ..... F02M 26/22 165/146
2009/0139693 A1* 6/2009 Qu ..... F28F 3/048 165/80.4
2010/0051248 A1* 3/2010 Inatomi ..... F28F 3/04 165/166
2012/0014063 A1* 1/2012 Weiss ..... H05K 7/209 361/697
2014/0014308 A1* 1/2014 Wu ..... H05K 7/20409 165/185
2015/0107801 A1* 4/2015 Campbell ..... H05K 7/20254 165/104.19
2015/0241142 A1* 8/2015 Vallee ..... F28F 3/046 165/185
2016/0131434 A1* 5/2016 Noishiki ..... F28F 7/02 165/166
2016/0282064 A1* 9/2016 Yoon ..... F28F 3/048
2016/0322121 A1* 11/2016 Kim ..... G21C 15/18
2017/0211893 A1 7/2017 Noishiki
2017/0268826 A1 9/2017 Noishiki et al.
2020/0049411 A1 2/2020 Takahashi et al.
2021/0116182 A1 4/2021 Yamakoshi et al.

* cited by examiner

STACKED HEAT EXCHANGER

TECHNICAL FIELD

The present invention relates to a stacked heat exchanger.

BACKGROUND ART

Conventionally, as disclosed in Patent Document 1 described below, a stacked heat exchanger is known in which a low temperature layer having a plurality of low temperature-side channels through which a low temperature fluid flows, and a high temperature layer having a plurality of high temperature-side channels through which a heating fluid for heating the low temperature fluid flows, are arranged side-by-side in a stacked state. The stacked heat exchanger disclosed in Patent Document 1 prevents the heating fluid from being cooled by the low temperature fluid to be frozen. That is, the stacked heat exchanger is configured to have a low temperature layer in which the plurality of low temperature-side channels is formed, a first high temperature layer adjacent to a first low temperature layer, in which the plurality of high temperature-side channels is formed, and a second high temperature layer adjacent to the first high temperature layer, in which the plurality of high temperature-side channel is formed. In this configuration, the high temperature-side fluid in the high temperature-side channels forming the first high temperature layer is cooled by the low temperature-side fluid. On the other hand, a part between the high temperature-side channels of the first high temperature layer and the high temperature-side channels of the second high temperature layer is maintained at a high temperature. Therefore, even if the high temperature-side fluid within the first high temperature layer is cooled, it is possible to prevent the high temperature-side fluid within the first high temperature layer from freezing.

In the stacked heat exchanger disclosed in Patent Document 1, it is possible to prevent freezing of the high temperature-side fluid within the first high temperature layer. However, in the heat exchanger, the second high temperature layer is an essential component in order to prevent excessive cooling of the high temperature-side fluid. Unfortunately, in this heat exchanger, the degree of freedom in design is small.

CITATION LIST

Patent Document

Patent Document 1: JP 2017-166775 A

SUMMARY OF THE INVENTION

An object of the present invention is to secure a degree of freedom in design without providing a second high temperature layer as an essential component to optimize channels on a high temperature side and a low temperature side, thereby preventing the temperature of a high temperature-side fluid within a high temperature layer from being excessively decreasing by cold of a low temperature-side fluid.

A stacked heat exchanger according to an aspect of the present invention includes a high temperature layer that has a plurality of channels into which a high temperature-side fluid is introduced, and a low temperature layer that has a plurality of channels into which a low temperature-side fluid is introduced, the low temperature layer being stacked on the high temperature layer, and the low temperature-side fluid having a temperature lower than the high temperature-side fluid. Each of the channels of the low temperature layer has an upstream-side part in which at least a part of the low temperature-side fluid evaporates by being heated by the high temperature-side fluid that flows within the high temperature layer, and a downstream-side part in which the low temperature-side fluid that has evaporated in the upstream-side part is heated by the high temperature-side fluid that flows within the high temperature layer. A ratio of an area of the plurality of upstream-side parts to a predetermined area in the low temperature layer is lower than a ratio of an area of the plurality of downstream-side parts to the predetermined area in the low temperature layer.

DESCRIPTION OF EMBODIMENTS

Hereinafter, embodiments will be described with reference to the accompanying drawings. Note that the following embodiments are examples embodying the present invention and are not intended to limit the technical scope of the present invention.

Figure 1A:
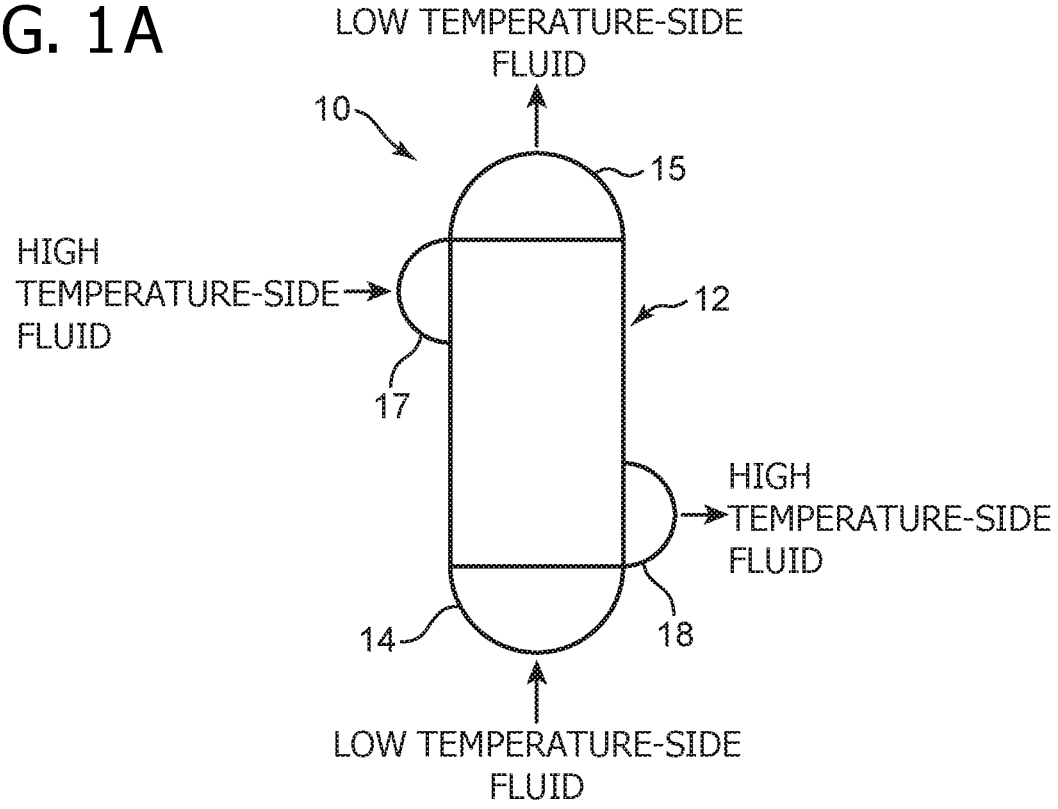
FIG. 1(*a*) is a front view of a stacked heat exchanger according to an embodiment, and FIG. 1(*b*) is a side view of the stacked heat exchanger.
Figure 1B:
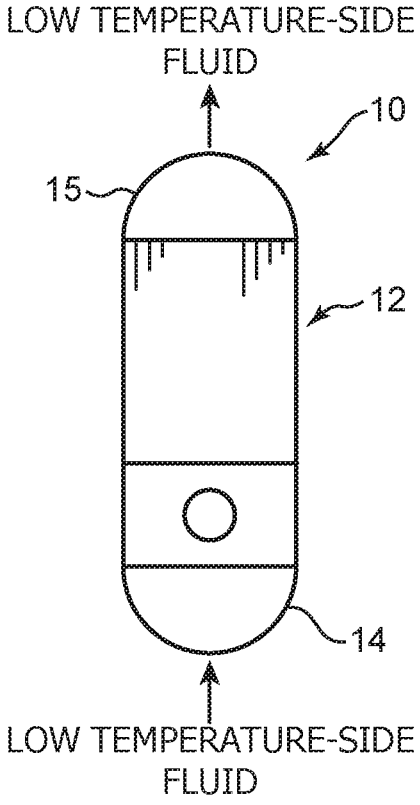

As shown in FIG. 1, a stacked heat exchanger 10 according to the present embodiment includes a stacked body 12, a low temperature-side inlet header 14, a low temperature-side outlet header 15, a high temperature-side inlet header 17, and a high temperature side-outlet header 18. The stacked heat exchanger 10 is configured by a so-called microchannel heat exchanger. The low temperature-side inlet header 14 and the low temperature-side outlet header 15 are connected to surfaces of the stacked body 12 formed in a substantially rectangular parallelepiped shape, which are located on the opposite sides. The high temperature-side inlet header 17 is connected to a surface of the stacked body 12 adjacent to the surface to which the low temperature-side outlet header 15 is connected. The high temperature-side outlet header 18 is connected to a surface of the stacked body 12 adjacent to the surface to which the low temperature-side inlet header 14 is connected. Further, the high temperature-side inlet header 17 and the high temperature-side outlet header 18 are connected to the surfaces of the stacked body 12 which are located on opposite sides.

The low temperature-side inlet header 14 is configured to be connected to a pipe (not shown) through which the low temperature-side fluid flows. The low temperature-side inlet header 14 is configured to distribute the low temperature-side fluid introduced through the pipe, to each of channels 25 within a low temperature layer 21 formed in the stacked body 12 to be described later. The low temperature-side outlet header 15 is configured to be connected to a pipe (not shown) for supplying the low temperature-side fluid flowing out of the stacked body 12 to a predetermined place. The low temperature-side fluid is heated to a predetermined temperature in the stacked body 12. Therefore, the low temperature-side fluid heated to this desired temperature flows out of the stacked body 12. The low temperature-side outlet header 15 causes the low temperature-side fluids flowing out of the respective channels 25 within the low temperature layer 21 to be joined, and causes the joined low temperature-side fluids to flow out to the pipe connected to the header 15.

The high temperature-side inlet header 17 is configured to be connected to a pipe (not shown) through which the high temperature-side fluid flows. The high temperature-side inlet header 17 is configured to distribute the high temperature-side fluid introduced through the pipe, to each of channels 27 within a high temperature layer 23 formed in the stacked body 12 to be described later. The high temperature-side outlet header 18 is configured to be connected to a pipe (not shown) for flowing the high temperature-side fluid flowing out of the stacked body 12 to a predetermined place. The high temperature-side outlet header 18 causes the high temperature-side fluids flowing out of the respective channels 27 within the high temperature layer 23 to be joined, and causes the joined high temperature-side fluids to flow out to the pipe connected to the header 18.

Examples of the low temperature-side fluid can include cryogenic liquefied gas such as liquefied natural gas, liquefied nitrogen, and liquefied hydrogen. Further, examples of the high temperature-side fluid can include liquid fluids such as warm water, seawater, and ethylene glycol. That is, the temperature of the liquid low temperature-side fluid may be lower than the freezing point of the high temperature-side fluid.

Figure 2:
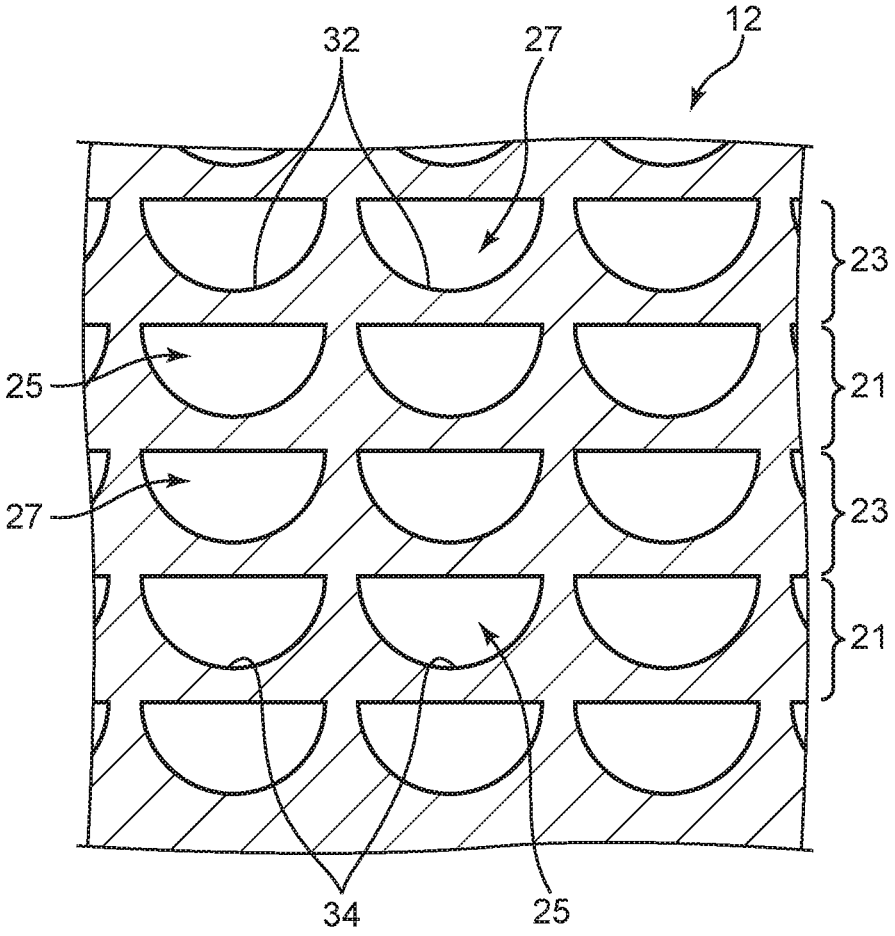
FIG. 2 is a view partially showing a cross-sectional view of a stacked body included in the stacked heat exchanger.

As shown in FIG. 2, the stacked body 12 has the low temperature layer 21 and the high temperature layer 23 stacked on the low temperature layer 21. The stacked body 12 has a plurality of low temperature layers 21 and a plurality of high temperature layers 23 such that the low temperature layers 21 and the high temperature layers 23 are alternately repeated. Each of the low temperature layers 21 and the high temperature layers 23 is made of a metal material having a high thermal conductivity, and the stacked body 12 is formed by, for example, diffusion bonding a plurality of stacked metal plates 29 and 30 to each other.

The low temperature layer 21 is formed as a flat region including the plurality of channels (the low temperature-side channels) 25. Further, the high temperature layer 23 is formed as a flat region including the plurality of channels (the high temperature-side channels) 27. The plurality of low temperature-side channels 25 are arranged to be aligned in one direction, and the plurality of high temperature-side channels 27 are arranged to be aligned in a direction parallel to the direction in which the low temperature-side channels 25 are aligned. That is, the metal plates 29, 30 having a plurality of grooves formed at intervals on the plate surfaces (the surfaces) of the metal plates 29, 30 are stacked to be diffusion bonded to each other, so that the low temperature-side channels 25 and the high temperature-side channels 27 are formed to be aligned in one direction. The low temperature-side channels 25 and the high temperature-side channels 27 each have a cross section formed into a semicircular shape. The low temperature-side fluid flows into each of the low temperature-side channels 25 through the low temperature-side inlet header 14. Further, the high temperature-side fluid flows into the high temperature-side channels 27 through the high temperature-side inlet header 17.

Here, diffusion bonding is a method of bringing the metal plates 29, 30 into close contact with each other and applying pressure to them under a temperature condition where the metal plates are heated to a temperature equal to or lower than a melting point of materials forming the metal plates 29, 30, and to such an extent that plastic deformation does not occur as much as possible, thereby bonding the metal plates 29, 30 to each other using diffusion of atoms generated between the bonding surfaces. Therefore, a boundary between the adjacent layers is not clearly shown. In addition, the layers are not limited to be bonded by diffusion bonding. In this case, the boundary between the layers may be shown.

Although not shown, respective end plates are arranged at opposite ends of the stacked body 12 in the stacking direction of the high temperature layers 23 and the low temperature layers 21. The high temperature layers 23 and the low temperature layers 21 are configured to be sandwiched between the end plates.

Figure 3:
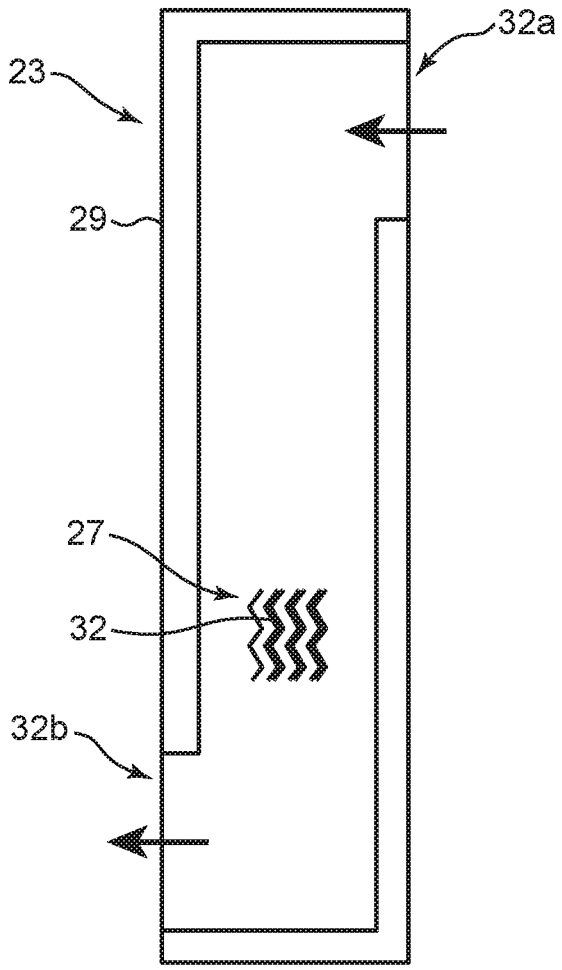
FIG. 3 is a view schematically showing a metal plate forming a high temperature layer in the stacked body.

FIG. 3 schematically shows a plate surface (an outer surface) of the metal plate 29 forming the high temperature layer 23. The metal plate 29 is formed in an elongated rectangular shape, and a plurality of grooves 32 is formed to be aligned on the plate surface of the metal plate 29. The grooves 32 are grooves that form the high temperature-side channels 27 when the stacked body 12 is formed. One end 32*a* of the groove 32 is open in the vicinity of an end on one long side of the rectangle, and the groove 32 extends from this opening in a direction along the short sides of the rectangle. The groove 32 is then bent from the direction along the short sides of the rectangle and extends in a direction along the long sides of the rectangle. Further, the groove 32 is bent again and extends again in the direction along the short sides. Another end 32*b* of the groove 32 is open in the vicinity of an end on the other long side (a long side opposite to the long side where the one end 32*a* of the groove 32 is open), which is opposite to the end on the one long side. When viewed as a whole, the groove 32 has a shape of bending at two places, but the groove 32 does not extend linearly in a microscopic view, but extends while meandering in a wave shape. In addition, the groove 32 may not formed in a wave shape but extend linearly.

Figure 4:
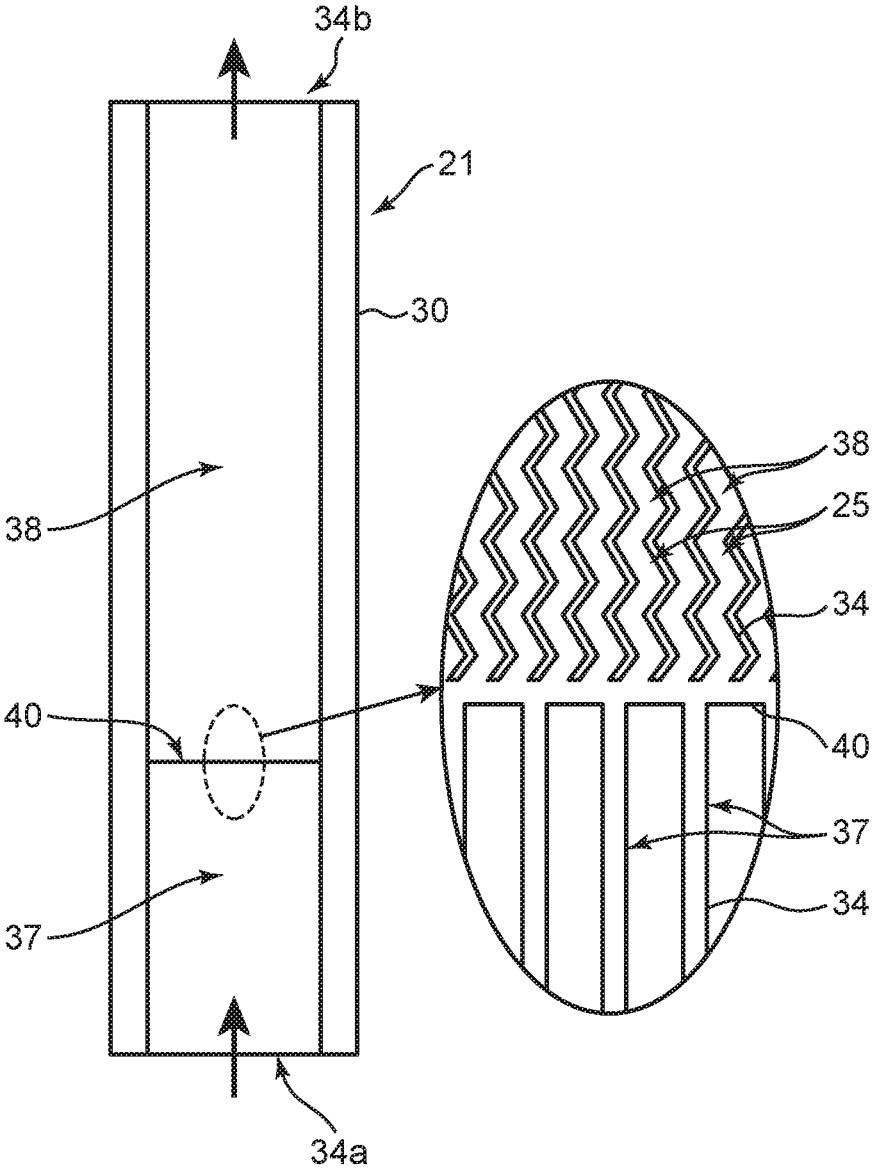
FIG. 4 is a view schematically showing a metal plate forming a low temperature layer in the stacked body.

FIG. 4 schematically shows a plate surface (an outer surface) of the metal plate 30 forming the low temperature layer 21. The metal plate 30 has the same outer shape as the metal plate 29 forming the high temperature layer 23, and a plurality of grooves 34 is formed to be aligned on the plate surface of the metal plate 30. The grooves 34 are grooves that form the low temperature-side channels 25 when the stacked body 12 is formed. One end 34*a* of the groove 34 is open to one short side of the rectangle, and the groove 34 extends in a direction along long sides of the rectangle. Further, the other end 34*b* of the groove 34 is open to the other short side of the rectangle.

The grooves 34 formed in the low temperature layer 21, that is, the low temperature-side channels 25 of the low temperature layer 21 each have an upstream-side part 37 and a downstream-side part 38. The upstream-side part 37 is a part connected to the low temperature-side inlet header 14, and the downstream-side part 38 is a part connected to the low temperature-side outlet header 15. That is, the low temperature-side fluid introduced through the low temperature-side inlet header 14 flows into the upstream-side part 37 of each of the low temperature-side channels 25. The low temperature-side fluid flowing out of each upstream-side part 37 flows through each downstream-side part 38, and is then joined in the low temperature-side outlet header 15. In the upstream-side part 37, the liquid low temperature-side fluid is heated by the heat of the high temperature-side fluid, and at least a part of it evaporates. In the downstream-side part 38, the evaporated low temperature-side fluid is further heated by the heat of the high temperature-side fluid. That is, the upstream-side part 37 is an evaporating part in which the low temperature-side fluid evaporates, and the downstream-side part 38 is a heating part in which the evaporated low temperature-side fluid is further heated.

Each of the upstream-side parts 37 has a shape that extends linearly, and each of the downstream-side parts 38 has a shape that extends while meandering in a wave shape. Further, the channel pitch between the adjacent upstream-side parts 37 is set to be wider than the channel pitch between the adjacent downstream-side parts 38. For example, the channel pitch in the upstream-side parts 37 is twice as wide as the channel pitch in the downstream-side parts 38. Thus, the upstream-side parts 37 are different from the downstream-side parts 38 in channel shape and channel pitch. Accordingly, the ratio of the area of the upstream-side parts 37 to the predetermined area in the low temperature layer 21 is set to be lower than the ratio of the area of the downstream-side parts 38 to the predetermined area in the low temperature layer 21. That is, to the predetermined area in the low temperature layer 21, the ratio of the area of the heat transfer surface formed by the upstream-side parts 37 is set to be lower than the ratio of the area of the heat transfer surface formed by the downstream-side parts 38. Thus, the heat transfer performance in the upstream-side parts 37 is kept lower than the heat transfer performance in the downstream-side parts 38. As a result, the wall temperature in the upstream-side parts 37 in which the low temperature-side fluid evaporates can be closer to the temperature of the high temperature layer 23 as compared with the case where the heat transfer performance in the upstream-side parts 37 is not kept low.

Figure 5:
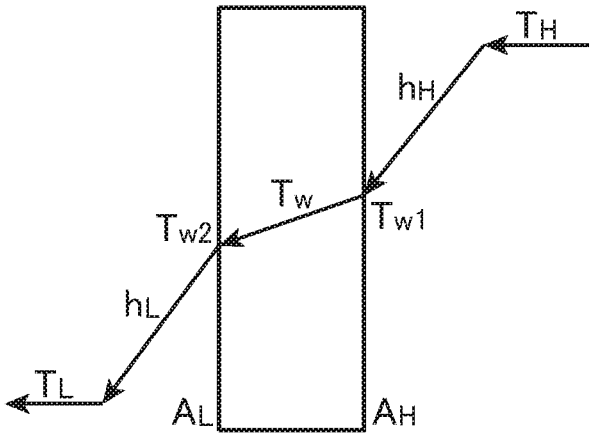
FIG. 5 is a view for describing a change in wall temperature based on a change in amount of heat transfer from the high temperature layer to the low temperature layer.

This point will be specifically described with reference to FIG. 5. FIG. 5 is a view for describing the relationship between the temperature of the high temperature-side fluid, the temperature of the member forming the high temperature layer 23 (the temperature of the metal plate 29 located between the high temperature-side channels 27 and the low temperature-side channels 25, that is, the wall temperature), and the temperature of the low temperature-side fluid.

The temperature of the high temperature-side fluid flowing in the high temperature-side channels 27 is $T_H$ (° C.), and the temperature of the low temperature-side fluid flowing in the low temperature-side channels 25 is $T_L$ (° C.), and the temperature of the member (the metal plate 29) located between the high temperature-side channels 27 and the low temperature-side channels 25, that is, the wall temperature is $T_W$ (° C.). The temperature $T_W$ of the member can be expressed as an average value of the temperature $T_{W1}$ (° C.) of the heat transfer surface in the high temperature-side channels 27 and the temperature $T_{W2}$ (° C.) of the heat transfer surface in the low temperature-side channels 25. The area of the heat transfer surface formed by the high temperature-side channels 27 is $A_H$ ($m^2$), the area of the heat transfer surface formed by the low temperature-side channels 25 is $A_L$ ($m^2$), the heat transfer coefficient on the heat transfer surface formed by the high temperature-side channels 27 is $h_H$ ($W/m^2$ K), and the heat transfer coefficient on the heat transfer surface formed by the low temperature-side channels 25 is $h_L$ ($W/m^2$ K).

The amount of heat $q_1$ passing through the heat transfer surface formed by the high temperature-side channels 27 and the amount of heat $q_2$ passing through the heat transfer surface formed by the low temperature-side channel 25 can be expressed by the following equations (1) and (2), respectively.

$$q_1 = h_H \times A_H \times (T_H - T_W) \quad (1)$$

$$q_2 = h_L \times A_L \times (T_W - T_L) \quad (2)$$

Since the amount of heat $q_1$ and the amount of heat $q_2$ are equal, assuming that the amount of heat $q_1$ is constant, for example, when the area $A_L$ of the heat transfer surface in the low temperature-side channels 25 is set to be small, the wall surface temperature $T_W$ is high according to the equations (1) and (2). That is, when the area of the upstream-side parts 37 in the low temperature-side channels 25 is set to be small, the wall temperature $T_W$ is high. Therefore, the wall temperature $T_W$ can be close to the temperature of the high temperature layer 23. Further, the same applies to the case where the heat transfer coefficient $h_L$ is set to be small in the upstream-side parts 37.

In addition, in the present embodiment, the upstream-side parts 37 are set to be different from the downstream-side parts 38 in channel shape and channel pitch, but the present invention is not limited to this. For example, the upstream-side parts 37 of the low temperature-side channels 25 may be formed linearly and the downstream-side parts 38 may be formed in a wave shape or a zigzag shape, while the upstream-side parts 37 may be set to be the same as the downstream-side parts 38 in channel pitch and channel width. Thus, the ratio of the area of the heat transfer surface of the upstream-side parts 37 to the predetermined area in the low temperature layer 21 is set to be lower than the ratio of the area of the heat transfer surface of the downstream-side parts 38 to the predetermined area in the low temperature layer 21. Alternatively, the upstream-side parts 37 may be formed to be the same as the downstream-side parts 38 in channel shape and channel width, while the channel pitch between the upstream-side parts 37 may be set to be wider than the channel pitch between the downstream-side parts 38. Alternatively, the upstream-side parts 37 may be formed to be the same as the downstream-side parts 38 in channel shape and channel pitch, while the channel width of the upstream-side parts 37 may be set to be narrower than the channel width of the downstream-side parts 38. Alternatively, the upstream-side parts 37 may be formed to be the same as the downstream-side parts 38 in channel shape, channel pitch, and channel width, while the channel depth of the upstream-side parts 37 may be set to be shallower than the channel depth of the downstream-side parts 38.

As shown in FIG. 4, a communication channel 40 is formed between the plurality of upstream-side parts 37 and the plurality of downstream-side parts 38 to be connected to them. The communication channel 40 has a shape extending in a direction transverse to the plurality of upstream-side parts 37. The communication channel 40 is connected to all of the upstream-side parts 37, so that the low temperature-side fluid that has flown through each of the upstream-side parts 37 joins the communication channel 40. Therefore, even if there is a deviation or difference in flow rate or pressure between the upstream-side parts 37, it is eliminated in the communication channel 40. Then, in that state, the low temperature-side fluid is diverted from the communication channel 40 to each of the downstream-side parts 38. In addition, the communication channel 40 may be omitted. That is, the plurality of upstream-side parts 37 and the plurality of downstream-side parts 38 are not communicated with each other through the communication channel 40, but each of the upstream-side parts 37 is directly connected to each of the downstream-side parts 38, so that the upstream-side parts 37 may be communicated with the downstream-side parts 38, respectively.

As described above, in the present embodiment, in the low temperature layer 21, the low temperature-side fluid before being heated by the high temperature-side fluid flows into the upstream-side parts 37, and the low temperature-side fluid heated by the high temperature-side fluid in the upstream-side parts 37 flows through the downstream-side parts 38. Therefore, the temperature of the low temperature-side fluid is relatively low in the upstream-side parts 37 and is relatively high in the downstream-side parts 38. Further, in the upstream-side parts 37 in which at least a part of the low temperature-side fluid evaporates, the ratio of the area of the heat transfer surface is set to be relatively lower than the ratio of the area of the heat transfer surface in the downstream-side parts 38. Therefore, in the upstream-side parts 37, heat transfer from the low temperature-side fluid to the member forming the low temperature layer 21 is prevented. Thus, it is possible to prevent the temperature of the member forming the low temperature layer 21 (the wall temperature of the low temperature-side channels 25 in the low temperature layer 21) from being excessively decreasing. Accordingly, it is possible to prevent an excessive decrease in temperature of the high temperature-side fluid, which is cooled by the low temperature-side fluid flowing through the upstream-side parts 37. On the other hand, in the downstream-side parts 38 in which the low temperature-side fluid that has evaporated in the upstream-side parts 37 is further heated, the ratio of the heat transfer surface area is set to be relatively high. Accordingly, the heat transfer performance in the predetermined area is relatively higher than that of the upstream-side part 37. Therefore, the low temperature-side fluid can be heated to a desired temperature. Thus, it is possible to obtain a low temperature-side fluid having a desired temperature while preventing an excessive decrease in temperature of the high temperature-side fluid due to the cold of the low temperature-side fluid. Moreover, even when a second high temperature layer adjacent to the high temperature layer 23 is not provided, it is possible to prevent an excessive decrease in temperature of the high temperature-side fluid.

Further, in the present embodiment, the downstream-side part 38 of the low temperature-side channel 25 has a wave shape. Therefore, it is possible to prevent a decrease in heat transfer performance when the low temperature-side fluid is entrained. That is, when the low temperature-side channel 25 is formed in a wave shape, even when the low temperature-side fluid flows in a gas-liquid two-phase state, the entrained droplets are likely to collide with the channel wall surface. That is, in the wavy channel, the flow of gas (low temperature-side fluid) is likely to be disturbed, so that formation of a gas layer along the channel wall surface is prevented. Therefore, it is possible to prevent the occurrence of a situation in which the heat transfer on the wall surface is hindered due to the formation of the gas layer. In other words, evaporation is promoted when the low temperature-side fluid flows with entrainment, so that it is possible to avoid a decrease in heat exchange performance.

Further, in the present embodiment, the low temperature layer 21 includes the communication channel 40 which is connected to each of the upstream-side parts 37 and is connected to each of the downstream-side parts 38. Therefore, even if uneven flow of the low temperature-side fluid occurs between the upstream-side parts 37, the low temperature-side fluid flows into the communication channel 40, thereby eliminating the uneven flow of the low temperature-side fluid. Thus, it is possible to prevent uneven flow when the low temperature-side fluid flows into the downstream-side part 38, and it is possible to prevent a difference in pressure of the low temperature-side fluid from occurring between the downstream-side parts 38. Further, the uneven flow in each of the channels is prevented, so that it is possible to prevent the occurrence of imbalance in thermal stress in the members forming the low temperature layer 21 and the high temperature layer 23.

In the present embodiment, the ratio of the area of the upstream-side parts 37 to the predetermined area in the low temperature layer 21 is set to 1/6 or more and 1/2 or less of the ratio of the area of the downstream-side parts 38 to the predetermined area in the low temperature layer 21. Since the area ratio is set to 1/6 or more, it is possible to prevent pressure loss in the upstream-side parts 37 from becoming too large and prevent the amount of heat exchange in the upstream-side parts 37 from becoming too small. This can prevent the low temperature-side fluid from not being heated to a predetermined temperature. Further, since the area ratio is set to 1/2 or less, it is possible to effectively prevent an excessive decrease in temperature of the high temperature-side fluid due to the cold of the low temperature-side fluid.

It should be noted that the present invention is not limited to the embodiment described above, and various modifications, improvements, and the like can be made without departing from the spirit of the present invention.

For example, in the embodiment described above, the upstream-side part 37 is linearly formed, and the downstream-side part 38 is formed in a wave shape. On the other hand, in the form shown in FIG. 6, both the upstream-side part 37 and the downstream-side part 38 are linearly formed, while the channel pitch of the upstream-side part 37 is set to be larger than the channel pitch of the downstream-side part 38. More specifically, the channel width of the upstream-side part 37 has the same as the channel width of the downstream-side part 38, while the channel pitch of the upstream-side part 37 is set to be twice the channel pitch of the downstream-side part 38. That is, the ratio of the area of the heat transfer surface of the upstream-side parts 37 to the predetermined area in the low temperature layer 21 is set to 1/2 of the ratio of the area of the heat transfer surface of the downstream-side parts 38 to the predetermined area in the low temperature layer 21. Therefore, it is possible to effectively prevent an excessive decrease in temperature of the high temperature-side fluid due to the cold of the low temperature-side fluid. Further, since the channel pitch in the upstream-side part 37 is set to be twice the channel pitch in the downstream-side part 38, the temperature in the stacked body 12 gradually changes in the vicinity of the inlet part of the low temperature-side fluid, preventing a change in thermal stress during startup, stoppage, and operation.

Figure 6:
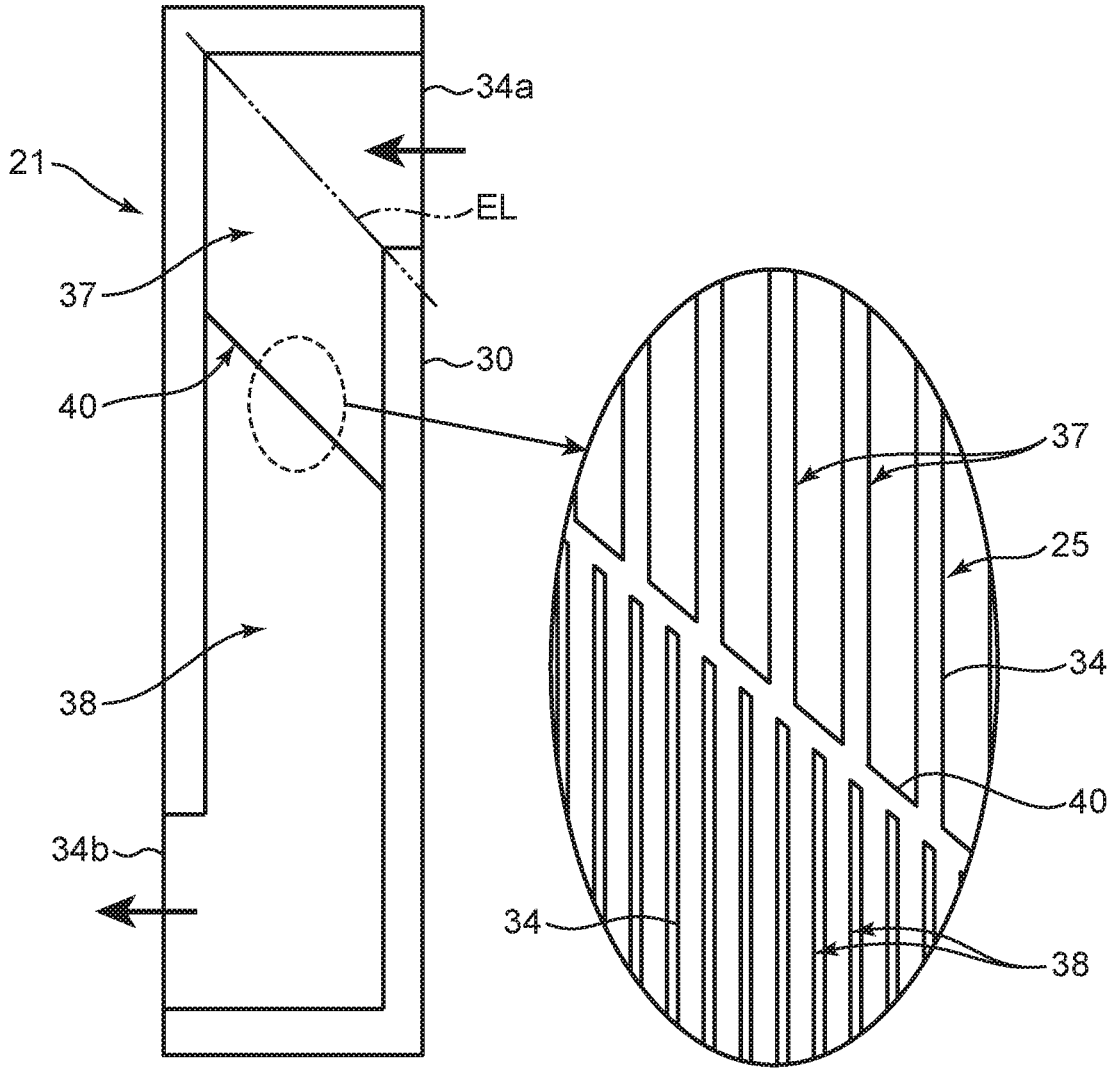
FIG. 6 is a view schematically showing a metal plate forming a low temperature layer included in a stacked heat exchanger according to another embodiment.

The form shown in FIG. 6 is different from the form shown in FIG. 4 in that the low temperature-side channel 25 is bent on the way. That is, one end 34*a* of the groove 34 formed on the plate surface (the front surface) of the metal plate 30 is open in the vicinity of an end on one long side of the rectangle, and the other end 34*b* of the groove 34 is open in the vicinity of an opposite end on the other long side. Then, the groove 34 extends from the one end 34*a* in the direction along the short sides of the rectangle, bends from that direction in the direction along the long sides of the rectangle, and further bends from that direction in the direction along the short sides of the rectangle. Further, the low temperature-side inlet header 14 is arranged at a longitudinal end of the stacked body 12, which is opposite to an end where the high temperature-side inlet header 17 is located, and the low temperature-side outlet header 15 is arranged at a longitudinal end of the stacked body 12, which is opposite to an end where the high temperature-side outlet header 18 is located. Therefore, even in this form, as in the form of FIG. 1, the low temperature-side fluid and the high temperature-side fluid flow in counterflow.

Even in the form shown in FIG. 6, the communication channel 40 is formed which is connected to the plurality of upstream-side parts 37 and the plurality of downstream-side parts 38. The width of the communication channel 40 is set to be the same as the width of the upstream-side parts 37 and the width of the downstream-side parts 38. For example, when the grooves 34 are formed by etching, if the width and depth of the communication channel 40 are the same as the width and depth of the upstream-side parts 37 and the width and depth of the downstream-side parts 38, it is possible to simultaneously process them, thereby facilitating manufacturing. However, the width and depth of the communication channel 40 are not limited to this. The width of the communication channel 40 may be set to be wider or narrower than the width of the upstream-side parts 37 and the width of the downstream-side parts 38, depending on the purposes and functions. Further, the depth of the communication channel 40 may be the same as or different from the depth of the upstream-side parts 37 and the depth of the downstream-side parts 38.

The communication channel 40 extends in a direction inclined with respect to the direction in which the upstream-side parts 37 and the downstream-side parts 38 extend. That is, the communication channel 40 extends in a direction parallel to an imaginary straight line EL which extends so as to connect the bent portions of the upstream-side parts 37. This is to make the parts of the upstream-side parts 37 which extend along the long sides of the rectangle have the same length since the low temperature-side channel 25 is formed in a shape that bends at two points on the way. The upstream-side parts 37 have the same length until they are connected to the communication channel 40, enabling pressure losses (flow resistances) of the upstream-side parts 37 in which the low temperature-side fluid flows in a gas-liquid two-phase to be made equal.

Figure 7:
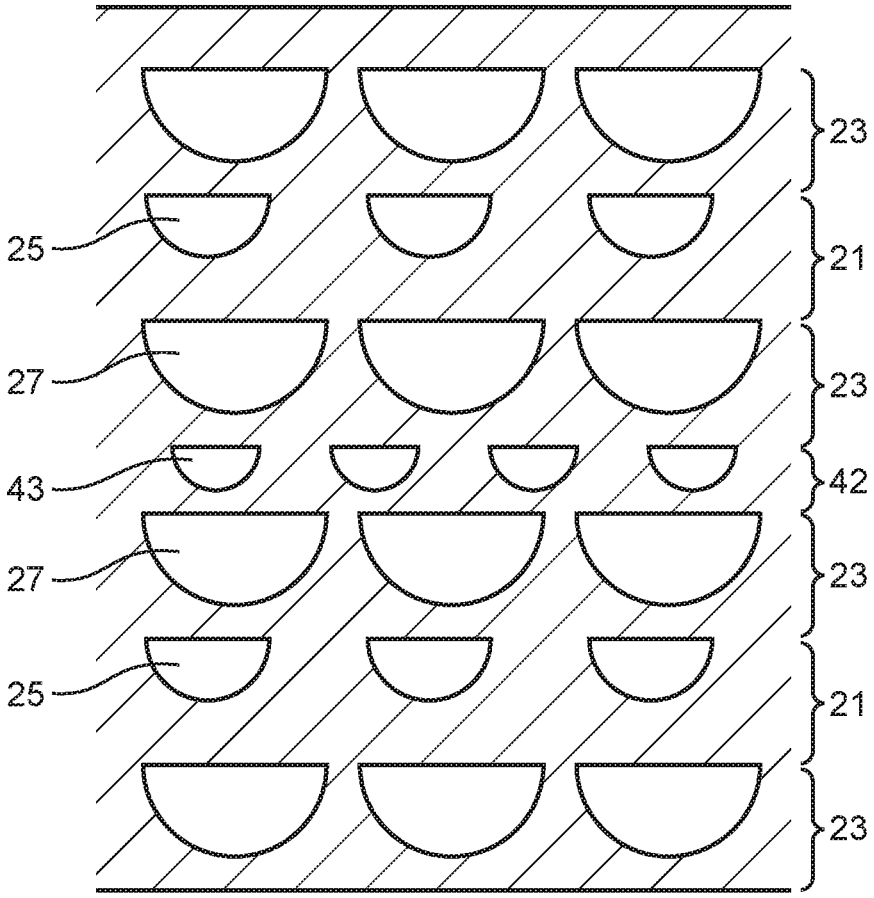
FIG. 7 is a view partially showing a cross-sectional view of a stacked body included in a stacked heat exchanger according to another embodiment.

In the embodiment described above, the stacked body 12 is configured such that the high temperature layers 23 and the low temperature layers 21 are alternately and repeatedly stacked. Instead of this, as shown in FIG. 7, the stacked body 12 may be configured to have a second high temperature layer 42 in addition to the high temperature layers 23 (the first high temperature layers 23) and the low temperature layers 21. The second high temperature layer 42 has a plurality of channels 43 and is stacked on an opposite side of the high temperature layer 23 from the low temperature layer 21. The high temperature-side fluid flows in the channels (the high temperature-side channels) 43 of the second high temperature layer 42, as in the high temperature layers 23. That is, the high temperature-side fluid that has flowed into the high temperature-side inlet header 17 flows not only into the channels (the high temperature-side channels) 27 of the high temperature layers 23 but also into the channels 43 of the second high temperature layer 42. The plurality of channels 43 formed in the second high temperature layer 42 are aligned in a direction parallel to the direction in which the channels 27 formed in the high temperature layer 23 are aligned.

In this form, the second high temperature layer 42 is unlikely to be cooled by the low temperature-side fluid, and is likely to be heated by the high temperature-side fluid to be maintained at a high temperature. Therefore, the high temperature layers 23, which is stacked on the upstream-side parts 37 of the low temperature layers 21 and on which the second high temperature layer 42 is stacked, are unlikely to be excessively cooled by the low temperature-side fluid. Thus, it is possible to further prevent the temperature of the high temperature-side fluid from excessively decreasing.

The area of the channels 43 of the second high temperature layer 42 is set to be smaller than the area of the channels 27 of the high temperature layers 23 in a plane orthogonal to a direction in which the high temperature-side fluid flows. Therefore, the flow rate of the high temperature-side fluid flowing through the channels 43 of the second high temperature layer 42 can be made higher than the flow rate of the high temperature-side fluid flowing through the channels 27 of the high temperature layers 23. However, the present invention is not limited to this configuration, and in the plane orthogonal to the flowing direction of the high temperature-side fluid, the area of the channels 43 of the second high temperature layer 42 may be set to be the same area as the cross-sectional area of the channels 27 of the high temperature layers 23. Further, in the plane orthogonal to the flow direction of the high temperature-side fluid, the area of the channels 25 of the low temperature layers 21, the area of the channels 27 of the high temperature layers 23, and the area of the channels 43 of the second high temperature layer 42 may be set to be the same area.

Here, the embodiments described above are outlined.

(1) A stacked heat exchanger according to the embodiments described above includes a high temperature layer that has a plurality of channels into which a high temperature-side fluid is introduced, and a low temperature layer that has a plurality of channels into which a low temperature-side fluid is introduced, the low temperature layer being stacked on the high temperature layer, and the low temperature-side fluid having a temperature lower than the high temperature-side fluid. Each of the channels of the low temperature layer has an upstream-side part in which at least a part of the low temperature-side fluid evaporates by being heated by the high temperature-side fluid that flows within the high temperature layer, and a downstream-side part in which the low temperature-side fluid that has evaporated in the upstream-side part is heated by the high temperature-side fluid that flows within the high temperature layer. A ratio of an area of the plurality of upstream-side parts to a predetermined area in the low temperature layer is lower than a ratio of an area of the plurality of downstream-side parts to the predetermined area in the low temperature layer.

In the stacked heat exchanger, in the low temperature layer, the low temperature-side fluid before being heated by the high temperature-side fluid flows into the plurality of upstream-side parts, and the low temperature-side fluid heated by the high temperature-side fluid in the plurality of upstream-side parts flows through the plurality of downstream-side parts. Therefore, the temperature of the low temperature-side fluid is relatively low in the upstream-side parts and is relatively high in the downstream-side parts. Further, in the upstream-side parts in which at least a part of the low temperature-side fluid evaporates, the ratio of the heat transfer surface area is set to be relatively lower than the ratio in the downstream-side parts. For example, channels that do not promote heat transfer, such as straight channels, may be used as the downstream-side parts. Accordingly, heat transfer from the low temperature-side fluid to a member forming the low temperature layer is prevented. Therefore, it is possible to prevent an excessive decrease in temperature of the member forming the low temperature layer (wall temperature of the low temperature layer). Thus, it is possible to prevent an excessive decrease in temperature of the high temperature-side fluid that is cooled by the low temperature-side fluid flowing in the upstream-side parts. On the other hand, in the downstream-side parts in which the low temperature-side fluid that has evaporated in the upstream-side part is further heated, the ratio of the heat transfer surface area is set relatively high. Accordingly, the heat transfer performance in a predetermined area is relatively higher than that in the upstream-side parts. Thus, the low temperature-side fluid can be heated to a desired temperature. Therefore, it is possible to obtain the low temperature-side fluid having a desired temperature while preventing an excessive decrease in temperature of the high temperature-side fluid due to cold of the low temperature-side fluid. Moreover, even when a second high temperature layer adjacent to a first high temperature layer is not provided, it is possible to prevent an excessive decrease in temperature of the high temperature-side fluid.

(2) In the stacked heat exchanger described above, due to a difference in at least one of channel shape, channel pitch, channel width, and channel depth, the ratio of the area of the plurality of upstream-side parts to the predetermined area in the low temperature layer may be lower than the ratio of the area of the plurality of downstream-side parts to the predetermined area in the low temperature layer.

(3) The stacked heat exchanger described above may further include a second high temperature layer that has a plurality of channels into which the high temperature-side fluid is introduced, the second high temperature layer being stacked on an opposite side of the high temperature layer from the low temperature layer.

In this aspect, the second high temperature layer is unlikely to be cooled by the low temperature-side fluid and is likely to be heated by the high temperature-side fluid to be maintained at a high temperature. Therefore, the high temperature layer, which is stacked on the upstream-side parts of the low temperature layer and on which the second high temperature layer is stacked, is unlikely to be excessively cooled by the low temperature-side fluid. Therefore, it is possible to further prevent the temperature of the high temperature-side fluid from excessively decreasing.

(4) The low temperature layer may further include a communication channel which is communicated with the upstream-side part of each of the channels and is communicated with the downstream-side part of each of the channels.

In this aspect, even if uneven flow of the low temperature-side fluid occurs in the upstream-side parts, the low temperature-side fluid flows into the communication channel, thereby eliminating the uneven flow of the low temperature-side fluid. Therefore, it is possible to prevent uneven flow when the low temperature-side fluid flows into the downstream-side parts, and it is possible to prevent a difference in pressure of the low temperature-side fluid between the downstream-side parts. Further, the uneven flow in each of the channels is prevented, so that it is possible to prevent the occurrence of imbalance of thermal stress in the member forming the low temperature layer.

(5) Each of the upstream-side parts may have the same length.

(6) Each of the upstream-side parts may have a shape extending linearly. In this case, each of the downstream-side parts may have a shape extending in a wave shape or a zigzag shape.

(7) Each of the upstream-side parts may have a shape extending linearly. In this case, each of the downstream-side parts may be different from the upstream-side part in at least one of channel pitch, channel width and channel depth, and may have a shape extending linearly.

As described above, according to the embodiments described above, it is possible to prevent the temperature of the high temperature-side fluid in the high temperature layer from excessively decreasing by limiting the cold of the low temperature-side fluid without providing the second high temperature layer as an essential component.

The invention claimed is:

1. A stacked heat exchanger, comprising:

a high temperature layer that has a plurality of channels into which a high temperature-side fluid is introduced; and a low temperature layer that has a plurality of channels into which a low temperature-side fluid is introduced, the low temperature layer being stacked on the high temperature layer, and the low temperature-side fluid having a temperature lower than the high temperature-side fluid, wherein each of the channels of the low temperature layer has an upstream-side part in which at least a part of the low temperature-side fluid evaporates by being heated by the high temperature-side fluid that flows within the high temperature layer, and a downstream-side part in which the low temperature-side fluid that has evaporated in the upstream-side part is heated by the high temperature-side fluid that flows within the high temperature layer, the plurality of upstream-side parts occupies an area in the low temperature layer that is less than an area occupied by the plurality of downstream-side parts in the low temperature layer, the low temperature layer further includes exactly one communication channel disposed between the plurality of upstream-side parts and the plurality of downstream-side parts that communicates with the upstream-side part of each of the channels and communicates with the downstream-side part of each of the channels;

the plurality of upstream-side parts are separate from each other except for at the one communication channel, and the plurality of downstream-side parts are separate from each other except for at the one communication channel;

a cross-sectional area of each of the plurality of upstream-side parts is substantially constant to a point where it communicates with the communication channel; and each of the upstream-side parts has a shape extending linearly without a bend from an upstream end to the point where it communicates with the communication channel.

2. The stacked heat exchanger according to claim 1, wherein due to a difference in at least one of channel shape, channel pitch, channel width, and channel depth, the plurality of upstream-side parts occupies the area in the low temperature layer that is less than the area occupied by the plurality of downstream-side parts in the low temperature layer.

3. The stacked heat exchanger according to claim 1, further comprising a second high temperature layer that has a plurality of channels into which the high temperature-side fluid is introduced, the second high temperature layer being stacked on an opposite side of the high temperature layer from the low temperature layer.

4. The stacked heat exchanger according to claim 1, wherein each of the upstream-side parts has the same length.

5. The stacked heat exchanger according to claim 1, wherein each of the downstream-side parts has a shape extending in a wave shape or a zigzag shape.

6. The stacked heat exchanger according to claim 1, wherein each of the downstream-side parts is different from the upstream-side part in at least one of channel pitch, channel width and channel depth, and has a shape extending linearly.

* * * * *